US007722099B2

(12) United States Patent
Bland

(10) Patent No.: US 7,722,099 B2
(45) Date of Patent: May 25, 2010

(54) SANITARY PRODUCT DISPOSAL

(76) Inventor: Vincent David Bland, 485 St. John St., Central Islip, NY (US) 11722

( * ) Notice: Subject to any disclaimer, the term of this patent is extended or adjusted under 35 U.S.C. 154(b) by 65 days.

(21) Appl. No.: 12/120,239

(22) Filed: May 14, 2008

(65) Prior Publication Data

US 2009/0282786 A1 Nov. 19, 2009

(51) Int. Cl.
*A01K 29/00* (2006.01)

(52) U.S. Cl. ..... 294/1.3; 294/1.4; 294/55; 294/118

(58) Field of Classification Search ..... 294/1.3, 294/1.4, 55, 118, 8.5, 99.2; 2/158, 159, 160
See application file for complete search history.

(56) References Cited

U.S. PATENT DOCUMENTS 3,813,121 A * 5/1974 Marvin ..... 294/1.3
4,788,733 A 12/1988 Lerner
5,358,295 A * 10/1994 Campbell ..... 294/1.3
5,370,431 A * 12/1994 Henninger et al. ..... 294/1.3
5,740,554 A 4/1998 Reed
6,832,796 B1 * 12/2004 Minassians ..... 294/1.3
7,216,905 B1 5/2007 Armes, Jr.
2007/0083179 A1 4/2007 Fuentes

* cited by examiner

*Primary Examiner*—Sameh H. Tawfik
(74) *Attorney, Agent, or Firm*—Ash Tankha

(57) ABSTRACT

Disclosed herein is an apparatus and method for hygienic disposal of a sanitary product. The apparatus comprises a biodegradable bag for disposal of the sanitary product. The biodegradable bag comprises a catch clip, a pull stick, and an adhesive strip. The catch clip, affixed at the closed end of the biodegradable bag, seizes the sanitary product into the biodegradable bag. The pull stick holds the biodegradable bag in a predefined position over the seized sanitary product during inversion of the biodegradable bag over the seized sanitary product. The inverted biodegradable bag with the seized sanitary product is then twisted and sealed airtight using the adhesive strip affixed towards the open end of the biodegradable bag. The biodegradable bag prevents the user from coming in contact with the sanitary product, thereby providing hygienic disposal of the sanitary product.

7 Claims, 11 Drawing Sheets

SANITARY PRODUCT DISPOSAL

BACKGROUND

This invention, in general, relates to collection and disposal of sanitary products that have been used to collect waste. More particularly, this invention relates to collecting a used sanitary product and disposing the sanitary product in a hygienic manner.

Used sanitary products are required to be disposed in a proper and safe manner. Often, used sanitary waste is inappropriately disposed. For example, sanitary products are often disposed by wrapping the sanitary product in the original wrapper or rolling the sanitary product in toilet paper and then discarding the sanitary product through a waste system. Due to the unsanitary conditions created by the manual handling of the sanitary product, there is a need for an apparatus that provides aseptic disposal of the sanitary product and protects a user from contact with and potential contamination by germs, bacteria, or viruses from the waste product leading to diseases such as Hepatitis B, genital warts, etc.

Sanitary products are some times disposed directly through a sewage system leading to blockage of the sewage system. The used sanitary product containing different types of bacteria and viruses find their way into water bodies and eventually cause environmental and health hazards. Moreover, there is a need for a biodegradable waste collection apparatus to prevent the accumulation of non-biodegradable material and the consequent hazardous effect on the environment.

Hence, there is a need for a biodegradable apparatus that allows removal and disposal of the used sanitary product in a hygienic manner.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

The apparatus and method disclosed herein addresses the above stated needs for seizing and hygienically disposing a sanitary product. An individual disposing waste, for example, a sanitary napkin, a tampon, a condom, a baby diaper, an adult diaper, clinical waste, etc. is herein referred to as a "user". The apparatus and method disclosed herein prevents physical contact between a user and the sanitary product during seizure of the sanitary product.

The apparatus disclosed herein comprises a biodegradable bag for enclosing the sanitary product for subsequent disposal. The biodegradable bag is composed of a lightweight biodegradable material for example, a polymer, paper, etc. The biodegradable bag comprises a catch clip, a pull stick, and an adhesive strip. The catch clip comprising a clamp section and a claw section is affixed at the closed end of the biodegradable bag. The adhesive strip is affixed towards the open end of the biodegradable bag. The catch clip seizes the sanitary product into the biodegradable bag. The pull stick comprising a pair of prongs holds the biodegradable bag in a predefined position over the seized sanitary product. The pull stick enables the user to invert the biodegradable bag while seizing the sanitary product into the biodegradable bag. The adhesive strip seals the biodegradable bag on twisting the open end of the biodegradable bag thereby making the biodegradable bag airtight.

The user positions the prongs of the pull stick for opening the biodegradable bag. The user advances the pull stick along the inner surface of the biodegradable bag for holding the biodegradable bag in a predefined position to seize the sanitary product into the biodegradable bag. The user presses the clamp section of the catch clip to open the claw section for seizing the sanitary product into the biodegradable bag. The user then twists the open end of the biodegradable bag containing the sanitary product and seals the biodegradable bag using the adhesive strip thereby allowing disposal of the biodegradable bag in a hygienic manner.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and instrumentalities disclosed herein.

DETAILED DESCRIPTION OF THE INVENTION

Figure 1:
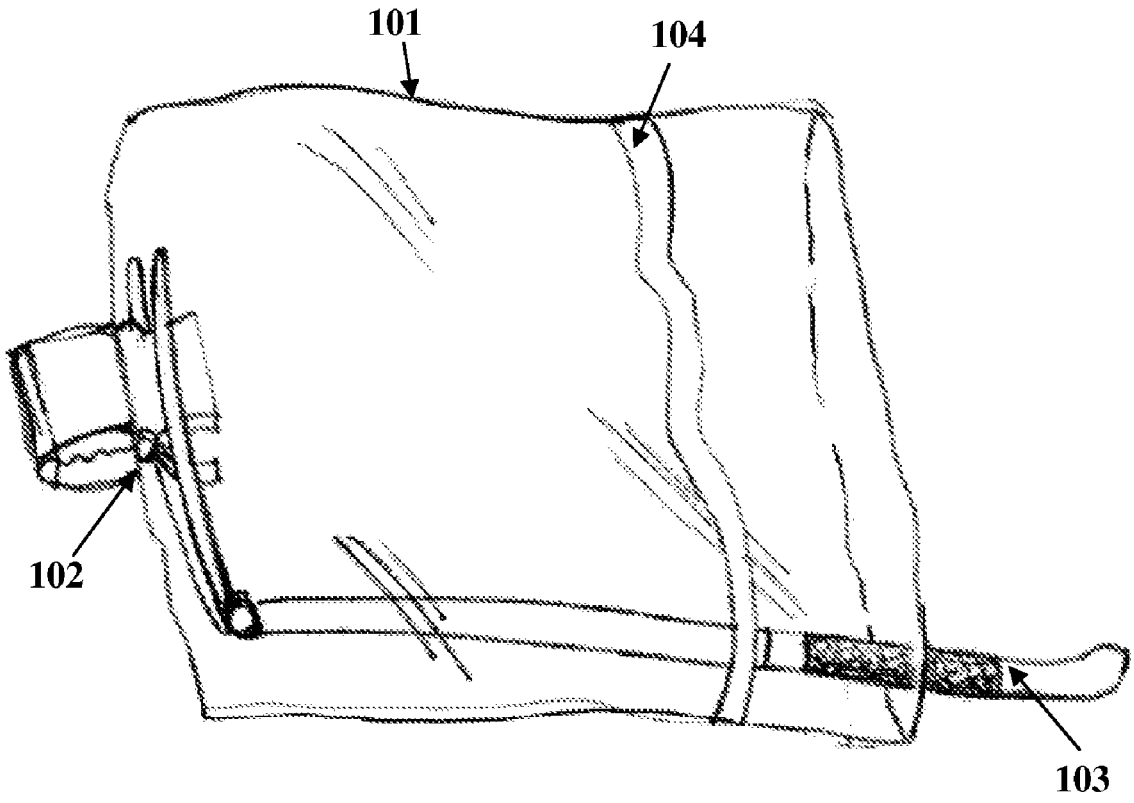
FIG. 1 illustrates an apparatus for hygienic disposal of a sanitary product.

FIG. 1 illustrates an apparatus for providing hygienic disposal of a sanitary product 501. As used herein, the term "sanitary product" refers to a sanitary napkin, a tampon, a condom, a baby diaper, an adult diaper, clinical waste, etc. An individual disposing waste, for example, a sanitary napkin, a tampon, a condom, a baby diaper, an adult diaper, clinical waste, etc. is herein referred to as a "user". The apparatus disclosed herein may also be used to hygienically dispose soiled or infected material and fabrics at home, in senior citizen communities, in hospitals, etc. Moreover, the apparatus disclosed herein may be used for disposal of forensic waste material from crime scenes and environmental waste.

The apparatus disclosed herein provides a biodegradable bag 101 composed of a lightweight biodegradable material, for example, a polymer, paper, etc. The biodegradable bag 101 has an open end and a closed end. The biodegradable bag 101 comprises a catch clip 102, a pull stick 103, and an adhesive strip 104. The catch clip 102 is affixed at the closed end of the biodegradable bag 101. The catch clip 102 seizes the sanitary product 501 into the biodegradable bag 101. The pull stick 103 in the biodegradable bag 101 allows the sanitary product 501 to be pulled into the biodegradable bag 101 without coming in contact with the user. The adhesive strip 104 seals the biodegradable bag 101 when the user twists the open end of the biodegradable bag 101 thereby making the biodegradable bag 101 airtight.

Figure 2:
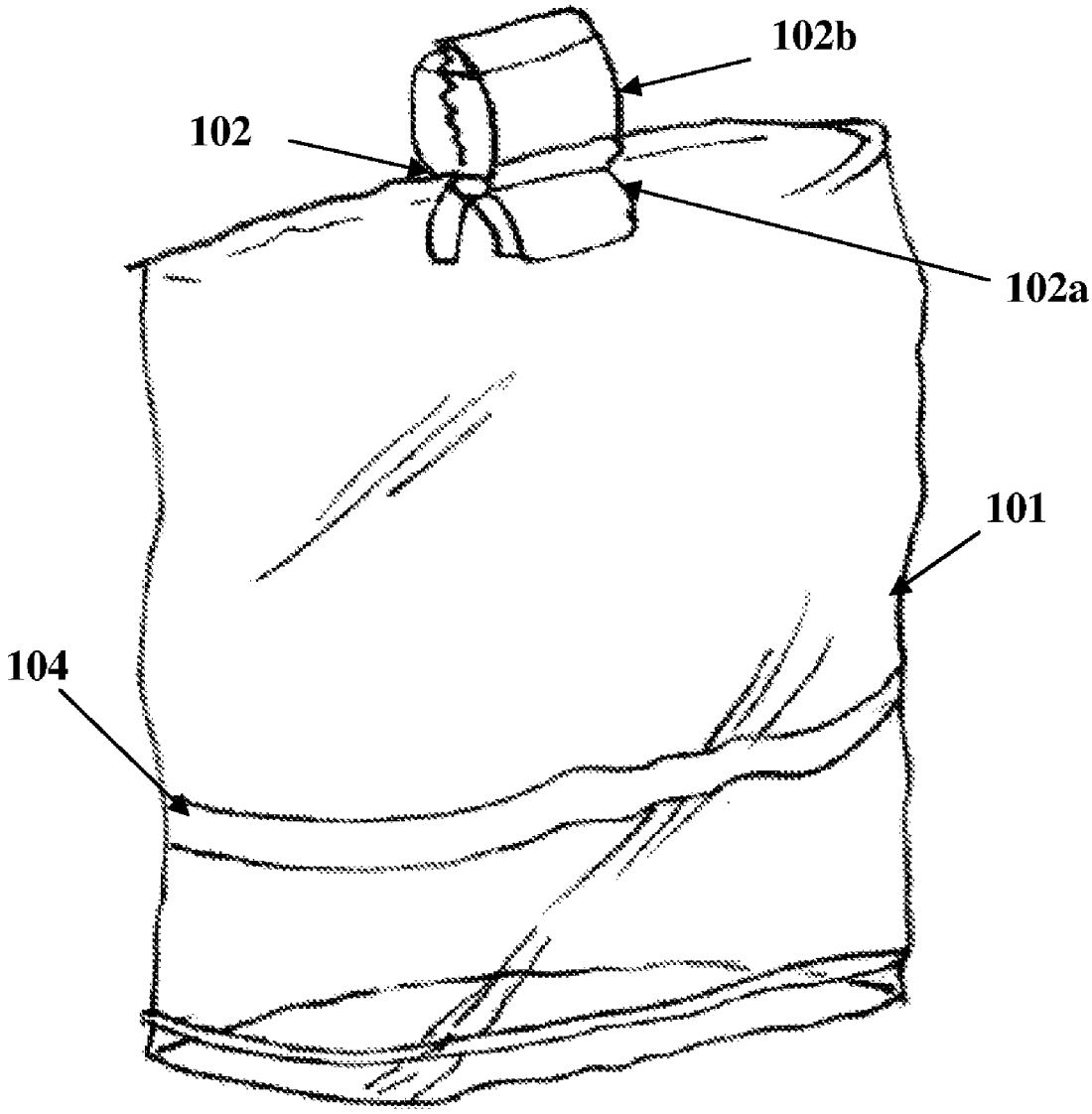
FIG. 2 exemplarily illustrates a catch clip affixed at the closed end of the biodegradable bag.

FIG. 2 exemplarily illustrates a catch clip 102 affixed at the closed end of the biodegradable bag 101. The catch clip 102 comprises two sections, namely a clamp section 102*a* and a claw section 102*b*. The clamp section 102*a* of the catch clip 102 is present inside the biodegradable bag 101 and the claw section 102*b* of the catch clip 102 protrudes outside the biodegradable bag 101. The material of the catch clip 102 may be a biodegradable material, for example, plastic, wood, etc. The claw section 102*b* may comprise a soft tip made of a soft gel like material to prevent injury to the user during seizure of the sanitary product 501. For example, when a female user tries to seize a short string of a tampon, the soft tip of the claw section 102*b* will not injure the female user. The user presses the clamp section 102*a* of the catch clip 102 to open the claw section 102*b* of the catch clip 102. The claw section 102*b* seizes the sanitary product 501 into the biodegradable bag 101. After the sanitary product 501 is seized, the user releases the clamp section 102*a* to close the claw section 102*b* thereby enclosing the sanitary product 501. The user then pulls the sanitary product 501 held by the claw section 102*b* into the biodegradable bag 101.

Figure 3A:
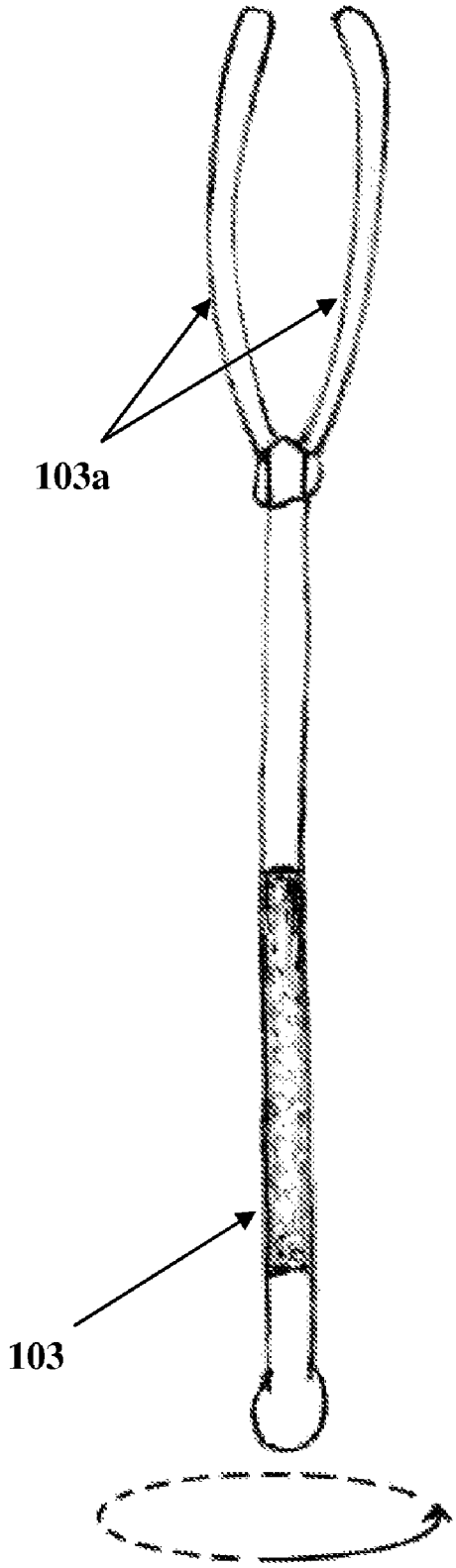
FIG. 3A exemplarily illustrates a front view of a pull stick provided in the biodegradable bag.
Figure 3B:
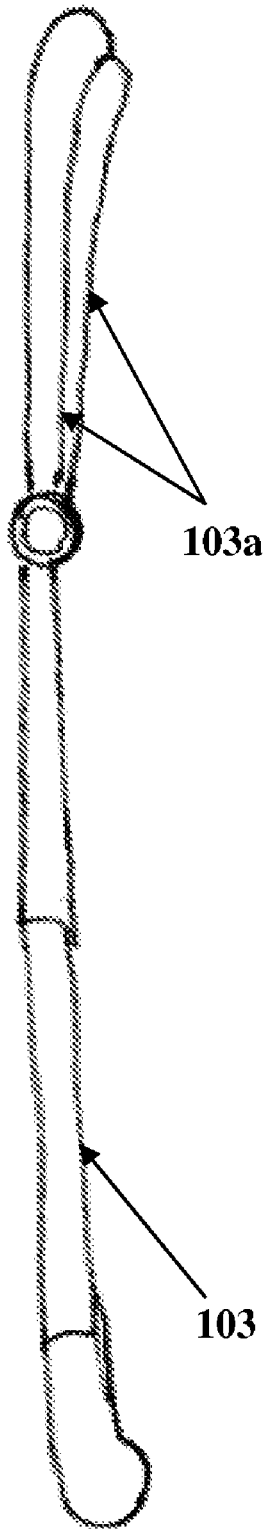
FIG. 3B exemplarily illustrates a side view of a pull stick provided in the biodegradable bag.
Figure 3C:
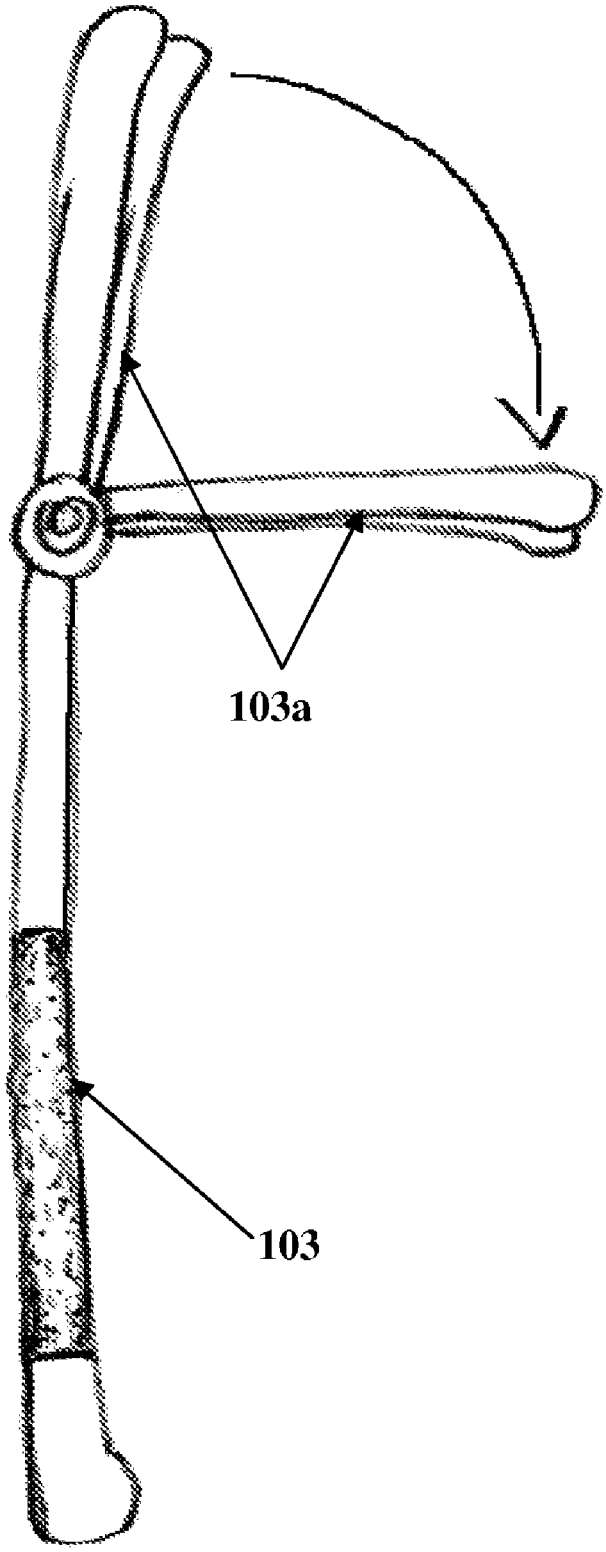
FIG. 3C exemplarily illustrates a side view of the pull stick with the prongs of the pull stick in an expanded position.

FIGS. 3A-3B exemplarily illustrate a front view and a side view of the pull stick 103 provided in the biodegradable bag 101 respectively. The pull stick 103 may be made of a biodegradable material, for example, a rigid plastic. The pull stick 103 comprises a fixed lower section and a movable upper section. The movable upper section comprises the prongs 103*a* for opening the biodegradable bag 101 prior to seizing of the sanitary product 501 into the biodegradable bag 101. The prongs 103*a* may be expanded for keeping the biodegradable bag 101 open as illustrated in FIG. 3C. In one embodiment of the apparatus disclosed herein, the prongs 103*a* of the pull stick 103 bend during seizing of the sanitary product 501 into the biodegradable bag 101. The pull stick 103 holds the biodegradable bag 101 in a predefined position over the sanitary product 501 and enables the user to invert the biodegradable bag 101 containing the seized sanitary product 501 thereby preventing the user from coming in contact with the sanitary product 501.

Figure 4:
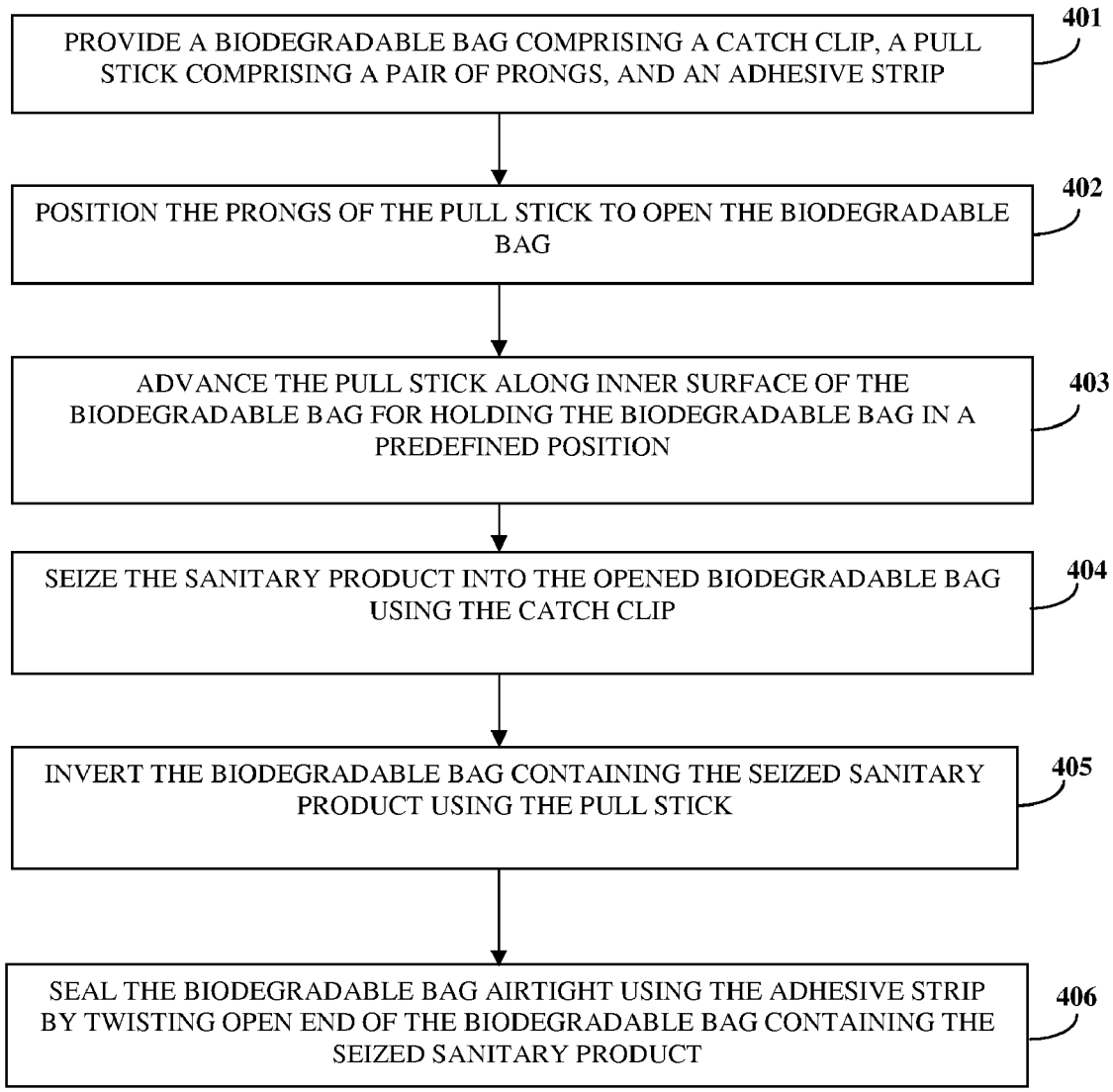
FIG. 4 illustrates a method of disposing a sanitary product hygienically.
Figure 5A:
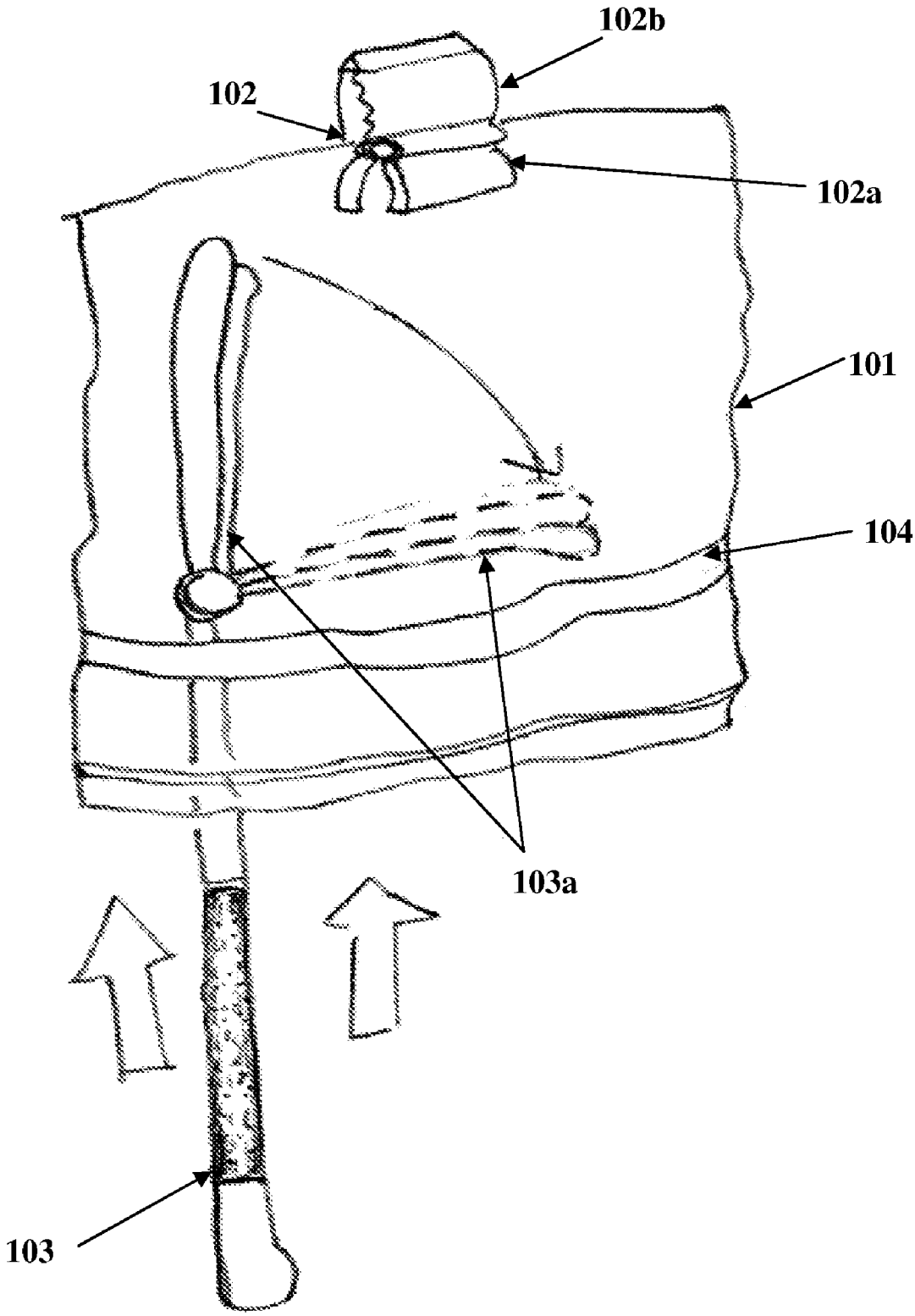
FIGS. 5A-5E exemplarily illustrate steps involved in seizing the sanitary product into the biodegradable bag for subsequent hygienic disposal.

FIG. 4 illustrates a method of disposing a sanitary product 501 hygienically. The method disclosed herein provides 401*a* biodegradable bag 101 comprising a catch clip 102 affixed at the closed end of the biodegradable bag 101, a pull stick 103 comprising a pair of prongs 103*a*, and an adhesive strip 104 affixed towards the open end of the biodegradable bag 101. In the method disclosed herein, the user unfolds the biodegradable bag 101 comprising the catch clip 102 and the pull stick 103. The user bends the prongs 103*a* of the pull stick 103 to one side of the biodegradable bag 101 and positions 402 the prongs 103*a* to open the biodegradable bag 101. The user then advances 403 the pull stick 103 along the inner surface of the biodegradable bag 101 as illustrated in FIG. 5A.

Figure 5B:
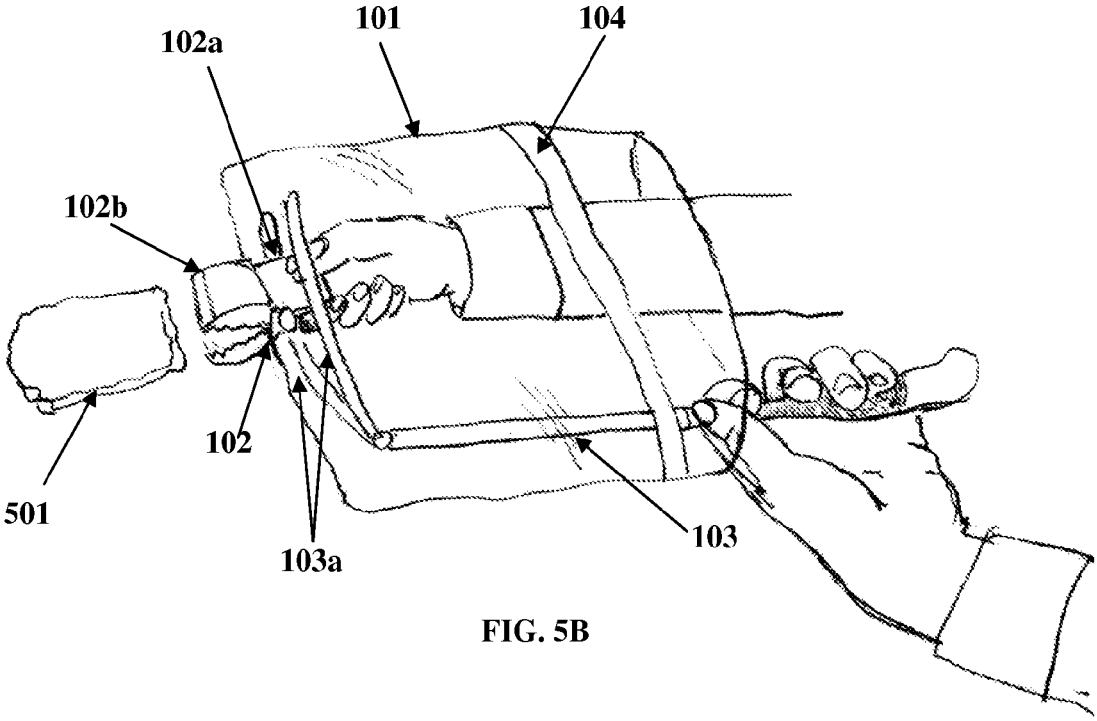
Figure 5C:
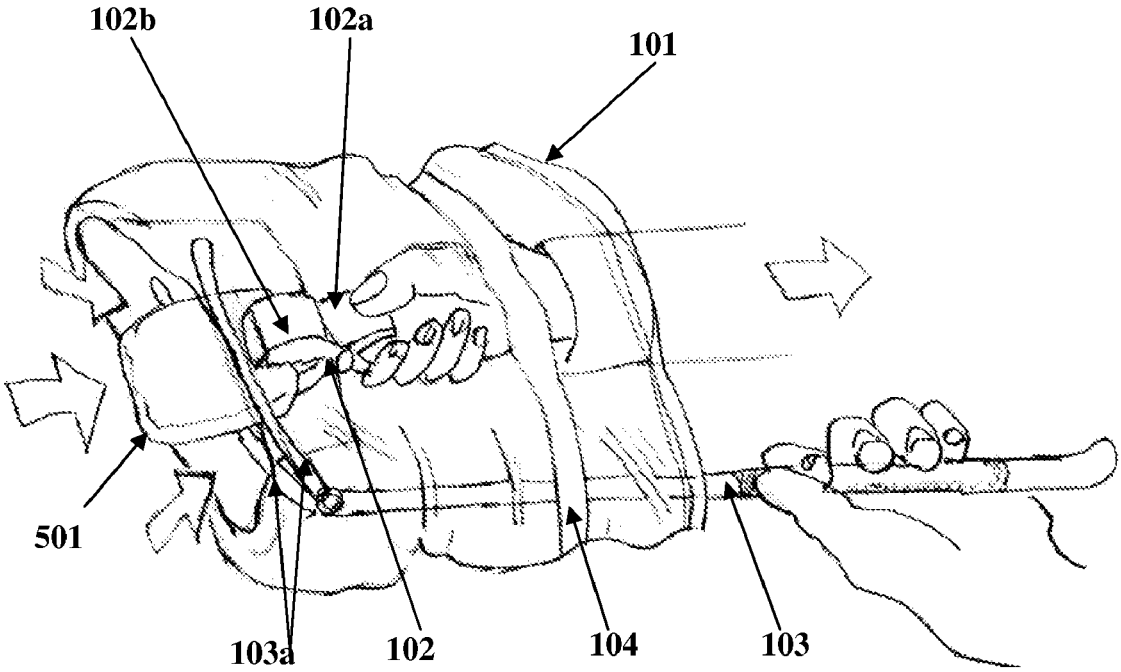
Figure 5D:
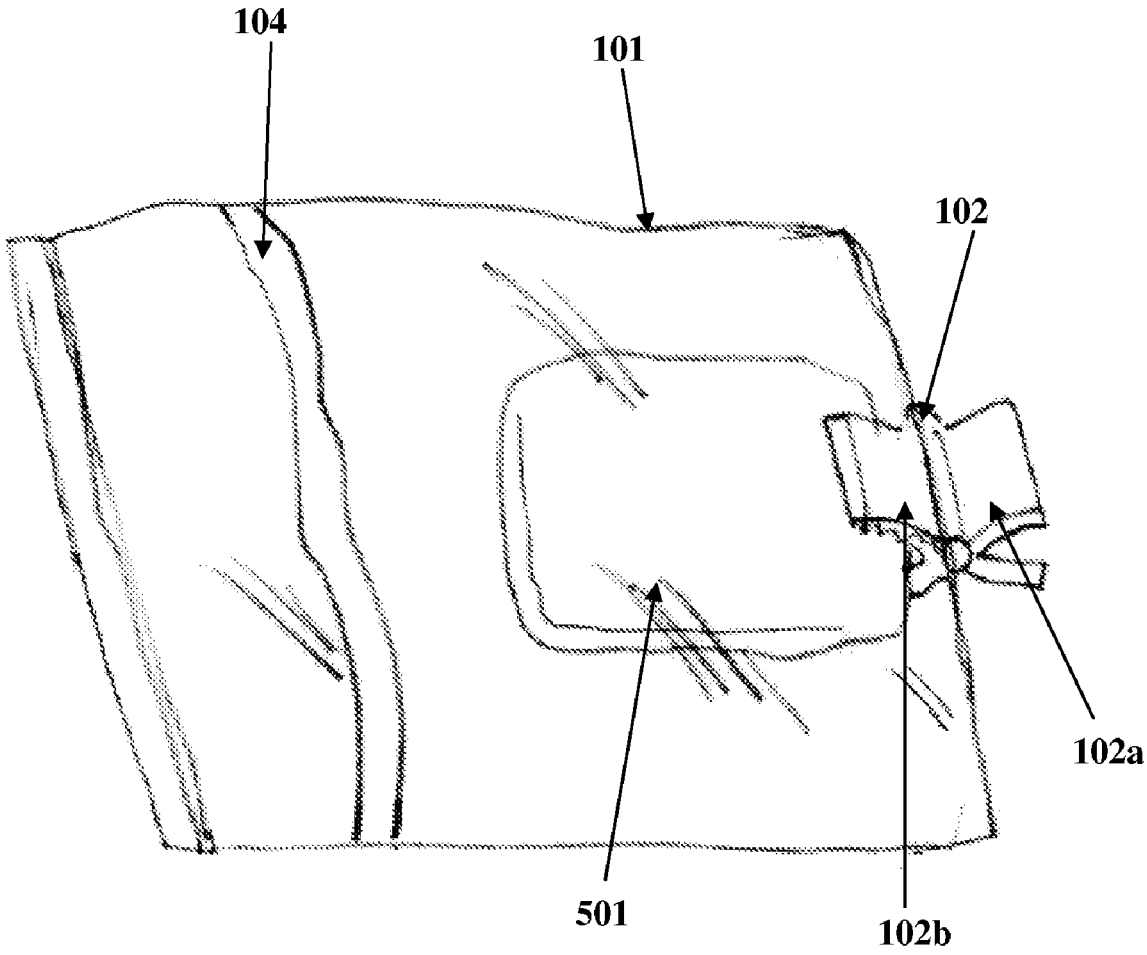
Figure 5E:
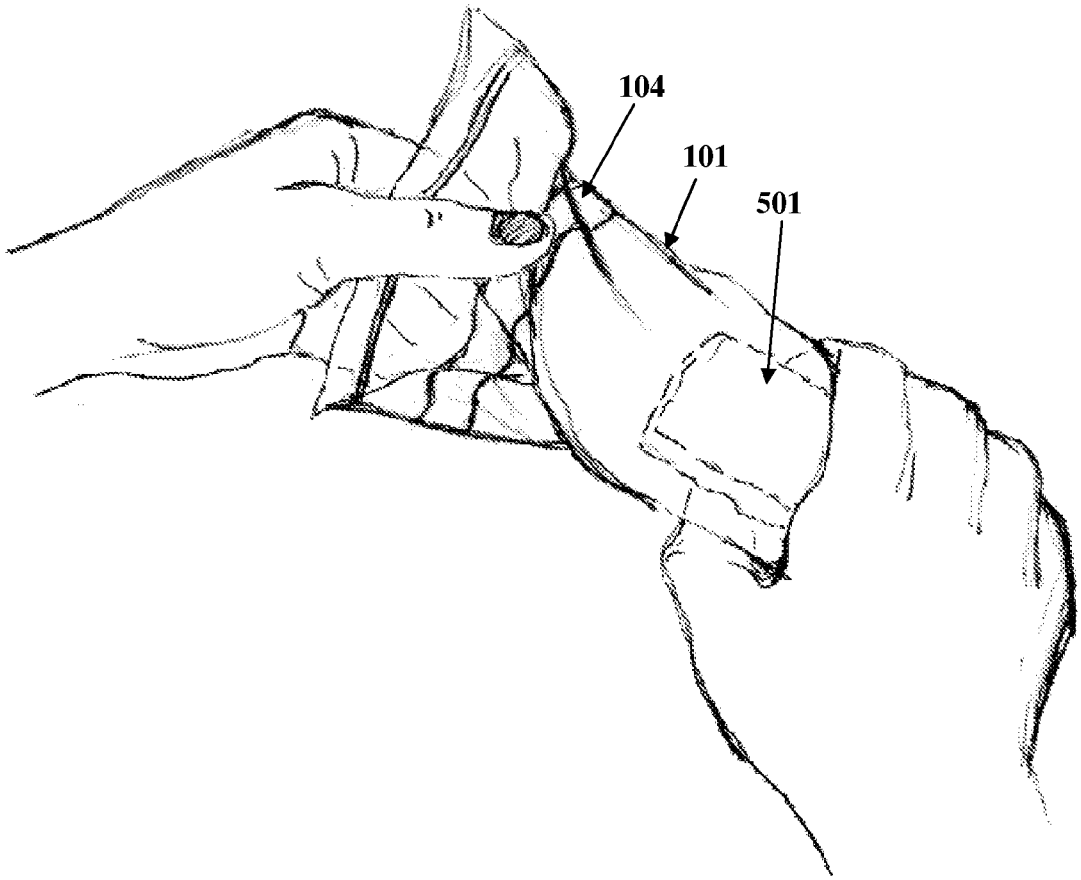

The user holds the biodegradable bag 101 with one hand in a predefined position over the sanitary product 501 using the pull stick 103. The user presses the clamp section 102*a* of the catch clip 102 with the user's free hand to open the claw section 102*b* of the catch clip 102 as illustrated in FIG. 5B. The user then seizes 404 the sanitary product 501 into the biodegradable bag 101 using the open claw section 102*b* of the catch clip 102 as illustrated in FIG. 5C. The pull stick 103 holds the biodegradable bag 101 in place over the seized sanitary product 501. While seizing the sanitary product 501 into the biodegradable bag 101, the user inverts 405 the biodegradable bag 101 using the pull stick 103. The inverted biodegradable bag 101 contains the seized sanitary product 501 as illustrated by FIG. 5D. The user then seals 406 the open end of the biodegradable bag 101 using the adhesive strip 104 by twisting the open end of the biodegradable bag 101 containing the seized sanitary product 501 as illustrated in FIG. 5E. The adhesive strip 104 facilitates airtight sealing of the biodegradable bag 101. The biodegradable bag 101 containing the used sanitary product 501 is then ready for disposal.

The biodegradable bag 101 collects the sanitary product 501 without physical contact between the user and the sanitary product 501 thereby providing hygienic disposal of the sanitary product 501.

The biodegradable bag 101 may be of different sizes for accommodating different sanitary products. For example, a small sized biodegradable bag 101 is used to dispose a sanitary napkin, a tampon, or a condom whereas a larger sized biodegradable bag 101 is used to dispose a baby diaper or an adult diaper.

The foregoing examples have been provided merely for the purpose of explanation and are in no way to be construed as limiting of the present method and system disclosed herein. While the invention has been described with reference to various embodiments, it is understood that the words, which have been used herein, are words of description and illustration, rather than words of limitation. Further, although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. An apparatus for hygienic disposal of a sanitary product, comprising:

a biodegradable bag for disposal of said sanitary product, wherein said biodegradable bag has an open end and a closed end;

a catch clip for seizing the sanitary product into the biodegradable bag, wherein said catch clip is affixed at said closed end of the biodegradable bag;

a pull stick comprising a pair of prongs for holding the biodegradable bag in a predefined position over said seized sanitary product during inversion of the biodegradable bag over the seized sanitary product; and an adhesive strip affixed towards said open end of the biodegradable bag, wherein said adhesive strip provides airtight sealing of the biodegradable bag containing the seized sanitary product on twisting the open end of the biodegradable bag;

whereby the biodegradable bag prevents physical contact between a user and the sanitary product during the disposal of the sanitary product by said user; and whereby the biodegradable bag provides the hygienic disposal of the sanitary product.

2. The apparatus of claim 1, wherein the sanitary product is one of a sanitary napkin, a tampon, a condom, a baby diaper, an adult diaper, and clinical waste.

3. The apparatus of claim 1, wherein biodegradable material of the biodegradable bag comprises one of a polymer and paper.

4. The apparatus of claim 1, wherein the catch clip comprises a clamp section and a claw section, wherein said clamp section is present inside the biodegradable bag and said claw section protrudes outside the biodegradable bag.

5. The apparatus of claim 4, wherein the clamp section is pressed by the user to open the claw section for seizing the sanitary product into the biodegradable bag.

6. The apparatus of claim 1, wherein said pull stick comprises a fixed lower section and a movable upper section, wherein said movable upper section comprises said prongs for opening the biodegradable bag prior to said seizing of the sanitary product into the biodegradable bag.

7. A method of disposing a sanitary product hygienically, comprising the steps of:

providing a biodegradable bag comprising a catch clip affixed at closed end of said biodegradable bag, a pull stick comprising a pair of prongs, and an adhesive strip affixed towards open end of the biodegradable bag;

positioning said prongs of said pull stick for opening the biodegradable bag;

advancing the pull stick along inner surface of the biodegradable bag for holding the biodegradable bag in a predefined position to seize said sanitary product into said open biodegradable bag;

seizing the sanitary product into the open biodegradable bag using said catch clip, wherein the biodegradable bag is inverted over said seized sanitary product; and sealing the biodegradable bag airtight using said adhesive strip by twisting said open end of the biodegradable bag containing the seized sanitary product.

* * * * *